US006942357B2

(12) United States Patent
Parsons et al.

(10) Patent No.: US 6,942,357 B2
(45) Date of Patent: Sep. 13, 2005

(54) MINIATURE FLASHLIGHT HAVING REPLACEABLE BATTERY PACK AND MULTIPLE OPERATING MODES

(75) Inventors: Kevin L. Parsons, Appleton, WI (US); W. Clay Reeves, Carrollton, TX (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 10/140,275

(22) Filed: May 6, 2002

(65) Prior Publication Data

US 2003/0206409 A1 Nov. 6, 2003

(51) Int. Cl.[7] ..... F21V 23/04; H01H 4/04; H01H 43/00

(52) U.S. Cl. ..... 362/183; 362/205; 362/802; 307/141

(58) Field of Search ..... 362/183, 295, 362/205, 200, 802, 204, 261, 251; 315/208, 185 S; 307/141

(56) References Cited

U.S. PATENT DOCUMENTS

| | | | | |
|---|---|---|---|---|
| 4,609,976 A | | 9/1986 | Geissler | |
| 5,412,548 A | | 5/1995 | Yee | |
| 5,622,423 A | | 4/1997 | Lee | |
| 5,697,695 A | | 12/1997 | Lin et al. | |
| 5,765,937 A | | 6/1998 | Shiau | |
| 5,957,566 A | | 9/1999 | Chiu | |
| 6,052,051 A | | 4/2000 | Whalen | |
| 6,095,661 A | * | 8/2000 | Lebens et al. | 362/184 |
| 6,190,018 B1 | | 2/2001 | Parsons et al. | |
| 6,249,089 B1 | * | 6/2001 | Bruwer | 315/200 A |
| 6,299,323 B1 | * | 10/2001 | Yu et al. | 362/116 |
| 6,585,391 B1 | * | 7/2003 | Koch et al. | 362/205 |
| 6,621,225 B2 | * | 9/2003 | Bruwer | 315/86 |

OTHER PUBLICATIONS

Advertisement from p. 5 from p. 5 of May/Jun. 2002 issue of *NATCHEZ Shooters Supplies* Magazine re "Photo Micro–Light 3" and "RAV'N Squeeze button switch".

* cited by examiner

*Primary Examiner*—Sandra O'Shea
*Assistant Examiner*—Guiyong Lee
(74) *Attorney, Agent, or Firm*—Welsh & Katz, Ltd.

(57) ABSTRACT

A method and apparatus are provided for operating a flashlight using a light emitting diode as a primary light source. The method includes the steps of activating the light emitting diode as the primary light source of the flashlight under one of a plurality of different operating modes and selecting the operating mode using a momentary contact disposed on an outer surface of the flashlight. In the disclosed embodiments, the flashlight takes the form of a relatively small size, generally flat housing having metallic side panels that may be of various colors and have indicia printed on them. The housing has an integral keyring extension enabling an article to be attached to the flashlight or for the flashlight to be attached to other articles, such as the clothing of a user.

49 Claims, 10 Drawing Sheets

MINIATURE FLASHLIGHT HAVING REPLACEABLE BATTERY PACK AND MULTIPLE OPERATING MODES

FIELD OF INVENTION

The present invention relates generally to flashlights, and more particularly to a miniature flashlight utilizing a light emitting diode ("LED") light source and a replaceable modular battery pack operative in response to predetermined switch actuation to effect momentary, selective signalling or continuous energizing of the LED.

BACKGROUND OF THE INVENTION

Conventional general-purpose flashlights are well known and find wide application by both law enforcement personnel and civilians. For example, flashlights are often used by law enforcement personnel during traffic stops to illuminate the interior of a stopped vehicle or to complete a police report in the dark. They are also used to facilitate searches of poorly lit areas and may be used to illuminate dark alleys or stairwells. Law enforcement personnel also use flashlights to check or adjust their equipment when positioned in a darkened area or at nighttime. Flashlights may also be used to send coded signals to one another. Thus, it is essential that law enforcement personnel carry a flashlight along with other law enforcement equipment such as a sidearm, handcuffs, and an expandable baton. With such a large number of items, it is often difficult and cumbersome for law enforcement personnel to carry all of the items on their person.

Conventional flashlights generally include an incandescent lightbulb and drycell batteries enclosed in an elongated tubular casing typically consisting of a body section and a head section. Flashlights of this type are often bulky and cumbersome. Law enforcement personnel frequently use a holster to carry a flashlight on their person. The size and weight of conventional flashlights can inhibit the mobility of law enforcement personnel when carried along with the other law enforcement equipment, and sometimes leads to the flashlight being purposely or inadvertently left behind. This presents a problem when the need for a flashlight arises and one is not readily accessible.

In addition to the use of flashlights by law enforcement personnel, civilians also use flashlights for a number of reasons. Besides the traditional home uses of flashlights, smaller flashlights are used for various security purposes. For example, when going to one's car late in the evening, it is not uncommon for an individual, especially a female, to carry a small flashlight with her. She can use the flashlight to assist in locating the keyhole in the dark. Additionally, she can use the flashlight to check whether someone is hiding in the back seat before getting into the car. Even small conventional flashlights, however, are cumbersome and inconvenient to carry for this purpose.

DESCRIPTION OF THE PRIOR ART

Although not proven particularly useful to law enforcement personnel, there exists in the prior art a small flashlight known as the Photon Micro Light. The Photon Micro Light consists of two flat, circular 3-volt batteries, a light emitting diode ("LED") and an outer shell that encloses the batteries and leads of the LED. The Micro Light uses a slide switch or pressure switch that activates the light by moving the leads of the LED into direct engagement with the batteries.

The outer shell consists of two hard plastic shell halves disposed on opposite sides of the batteries and held together with threaded screws. The Micro Light has a number of disadvantages in that it lacks the durability required for a miniature flashlight, and also lacks an internal structure for protecting and securing the batteries and LED, having only the hard plastic outer shell to protect the internal components. The Micro Light may therefore be adversely affected when subjected to shock. Further, the use of screws to assemble the outer shell halves together increases the time and cost of assembly. In addition, the Micro Light has a very small keyring hole that is not well adapted for securing the flashlight to a keychain, or to otherwise readily attach and release the flashlight from one's clothing.

Another major drawback with the Micro Light is that it uses either a slide switch or pressure switch which upon activation brings both leads of the LED into direct engagement with the batteries. This results in increased fatigue on the leads of the LED and ultimately results in failure. Moreover, because of its external shape and hard plastic outer shell construction, the Micro Light is not suitable for receiving markings or engravings on the outside surfaces thereof. In many instances it is desirable to color code the exterior of the flashlight, or to provide engravings, markings, or other indicia on the exterior surface. The Micro Light is not well suited for any such color coding or desired markings or engravings.

The aforedescribed drawbacks experienced with prior conventional flashlights and the reduced size Photo Micron Light created a need for a compact, reliable and lightweight flashlight that assures long life and can be readily carried on the person of a law enforcement officer or civilian, such as being easily releasably attachable to one's clothing or a keychain to insure that the flashlight remains in possession of the user and can be quickly accessed when needed. This need has been met in large part by the miniature LED flashlight disclosed in U.S. Pat. No. 6,190,018 that is assigned to the assignee of the present invention and is incorporated herein by reference.

SUMMARY OF THE INVENTION

The subject invention is directed to a small, compact flashlight useful to both law enforcement personnel and civilians. The flashlight includes a light source, which is preferably a high intensity LED having a pair of leads extending therefrom, and a non-conductive power source frame, also termed a battery frame, having a cavity or recess opening outwardly of the battery frame and adapted to releasably receive a modular self-contained power source, such as a modular battery pack. The battery frame also has a recess for receiving and at least partially enclosing the LED such that the LED leads extend into the battery frame.

The battery frame includes a printed circuit board plate and attached printed circuit board that together defines a side boundary of the recess that receives the modular battery pack. The battery frame also has a momentary contact pushbutton. A processor on the printed circuit board activates the LED under one of a number of different operating modes. The pushbutton may be used to select and control an operating mode of the LED.

A pair of side covers are retained on opposite sides of the battery frame by side shell members so that outer surfaces of the side covers are exposed for receiving indicia thereon. The switch push button is received through a suitable opening in the side cover adjacent the printed circuit board so as to enable an operator to actuate the push button to effect momentary or continuous interconnection of the LED to the battery pack without either lead of the LED physically contacting the battery pack. The battery frame protects the modular battery pack and positions it in precise relation to the light source and the switch slide plate. The battery frame also cushions the internal elements from the adverse affects of any shock the flashlight might be subjected to.

The battery pack power source has sufficient power to energize the LED and preferably includes a pair of circular batteries having generally flat sides, frequently referred to as coin cells. A pair of stacked long-life 3-volt batteries of the coin cell type are enclosed within a non-conductive battery holder sized to be slidingly inserted within the similar size recess in the battery frame. The battery holder and battery frame are mutually cooperable to prevent full insertion of the battery pack into the recess unless the battery holder is disposed in a predetermined orientation, thus assuring proper positioning of the positive and negative terminals of the batteries relative to the LED leads. The battery holder has a boss or pusher member thereon that extends into an opening in the battery frame so that a pusher member on a similar battery pack can be inserted into the opening from externally of the flashlight to initiate removal of a battery pack disposed within the recess.

As noted, the light source is preferably an LED that has a high luminous intensity. Manufacturers of LEDs grade the LED according to its quality. The highest quality LEDs are given an "E" grade. The next highest quality is a "D" grade. LEDs with a "D" grade can be equipped with a lens to approximate the quality of an "E" grade LED. Although the flashlight of the present invention can be used with any conventional LED, an "E" grade LED or lensed "D" grade LED is preferred. Such a high intensity LED may be obtained from Nichia Corporation Tokushima, Japan, and has from three to five times the luminous intensity of a conventional LED. The LED preferably emits blue light, although the present invention may be used with any color LED. Blue light helps to preserve a user's night vision compared with conventional flashlights emitting white light. The use of a high intensity LED as the light source provides significant advantages over conventional filament type flashlight bulbs. A LED light provides a soft general illumination as compared to the bright glare or "white out" experienced with traditional filament lamps. This is particularly important in police and security work where a police officer requires lighting, such as in a vehicle, but for security reasons does not want to use a bright light that lights up the inside of the vehicle and makes the officer a "target" as experienced with traditional flashlights. Moreover, the bright light of traditional filament type flashlight makes it hard to write a report due to glare and grossly inhibits the officer's night vision. For other applications blue-green LEDs can be used, for example, in situations where compatibility with night vision equipment is desired. Other LED colors can also be used. Red LEDs can be used in applications where the preservation of night vision is desired or for use by pilots and photographers. Infrared LEDs can be used where special signaling capabilities are required or for use with equipment that senses infrared light.

One lead of the LED engages a first electrical conductor contact that is supported by the printed circuit board and coupled to a switch terminal of the printed circuit board. The other LED lead is similarly adapted to be contacted by a second electrical conductor contact supported by the printed circuit board. The second conductor contact contacts the positive terminal of the battery pack through an opening in the battery holder. A third electrical conductor contact is supported by the printed circuit board so as to contact a negative terminal of the battery pack in the battery frame recess through an opening in the battery holder. A switching arrangement within the printed circuit board functions to activate the LED by internally electrically connecting the first electrical conductor to the third electrical conductor.

In this manner, the LED leads are never flexed to make direct contact with the batteries in the battery pack. The switch arrangement thus reduces wear and possible fatigue failure of the leads of the LED, thereby increasing the life, and overall reliability of the flashlight.

The battery frame may have a plurality of pegholes located about the periphery of each side to receive correspondingly positioned pegs or pins formed on the inner periphery of the side shells to facilitate attachment. The mating pegs and pegholes facilitate assembly of the flashlight by allowing the parts to be precisely aligned during assembly. It has been found that gluing the side shells to the battery frame to secure the side covers against the opposite sides of the battery frame may also provide a suitable assembly technique. Alternately, ultrasonic welding can be used to attach the non-metallic parts. Unlike the prior art, separate screws are not needed to secure the parts in assembled relation.

The side covers are fixed against opposite sides of the battery frame by the outer open side shells or frames so as to lie in substantially parallel planes and preferably have generally flat outer surfaces that are capable of receiving engravings or markings. For example, a company or individual may wish to engrave or imprint the side covers with surface indicia such as a company logo, name of a product or other promotional or advertising indicia on either or both of the side covers. A die struck medallion could also be affixed to one or both side covers. The side covers can be made of a variety of materials, such as metal, plastic, or other protective materials, but are preferably made of a suitable strength aluminum. Aluminum side panels provide additional protection to the internal components of the flashlight, can be of different contrasting colors as between themselves and between themselves and the outer periphery of the battery frame and/or open side shells, and can be easily engraved or imprinted as by laser engraving, silk screening, inking, pad printing, or other known printing or marking techniques.

The battery frame is provided with a keyring extension that is preferably formed integral with the battery frame. The keyring extension extends outwardly from an end of the battery frame opposite the LED and includes a keyring lock such that when a force is exerted against the keyring lock, the keyring extension is opened to permit keys or a keyring to be attached to the keyring extension. The keyring lock is preferably spring-biased and may be pivotally mounted on the battery frame. The keyring extension also facilitates attachment and detachment of the flashlight from any number of items, such as the zipper actuator of a coat or backpack, the handle of a purse or briefcase, a beltloop, or any other handle or case.

The flashlight of the present invention is preferably made sufficiently small, flat and compact to be readily carried in the palm of one's hand or in a pocket or purse, on the clothing, or on the keychain of law enforcement personnel or civilians. In this manner, the flashlight may be quickly and readily retrieved and operated.

One of the primary objects of the present invention to provide a flashlight that is of a small, relatively flat and compact size, is exceptionally durable and reliable, and utilizes a battery frame to support and protect a light source, preferably a high-intensity LED, a power source in the form of a replaceable modular battery pack, and a switch mechanism that is operative to close a circuit including the battery pack and LED to enable momentary or continuous energizing of the LED in a number of operating modes without the LED leads physically contacting batteries of the battery pack.

Further objects, advantages and features of the present invention will become apparent to those skilled in the art from the following detailed description of preferred embodiments when taken in conjunction with the accompanying drawings in which like reference numerals designate like elements throughout the several views.

Figure 1:
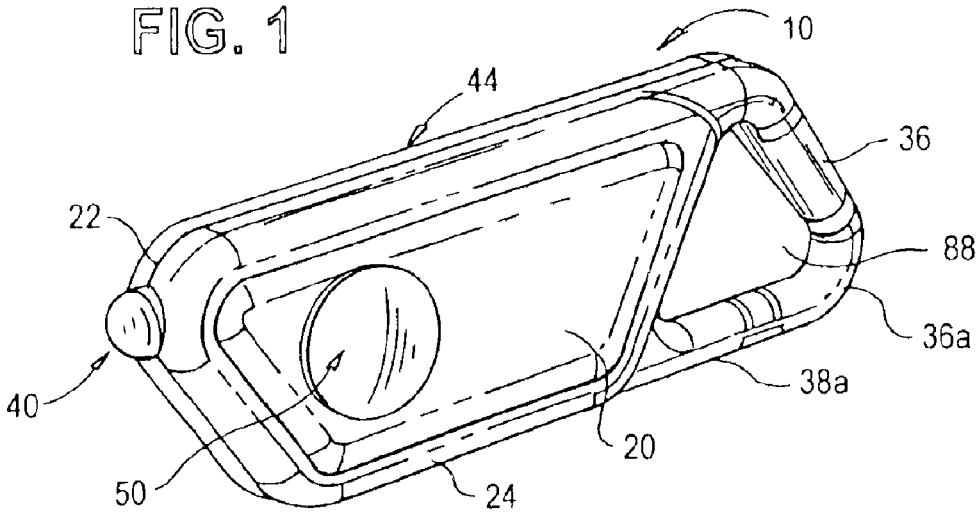
FIG. 1 is a perspective view of a flashlight constructed in accordance with the present invention.

While the present invention is susceptible of various modifications and alternative forms, specific embodiments thereof are shown by way of example in the drawings and will herein be described in detail. It should be understood, however, that the drawings and detailed description thereof are not intended to limit the invention to the particular form disclosed, but on the contrary, the invention is intended to cover all modifications, equivalents and alternatives falling within the spirit and scope of the invention.

DETAILED DESCRIPTION

Figure 2:
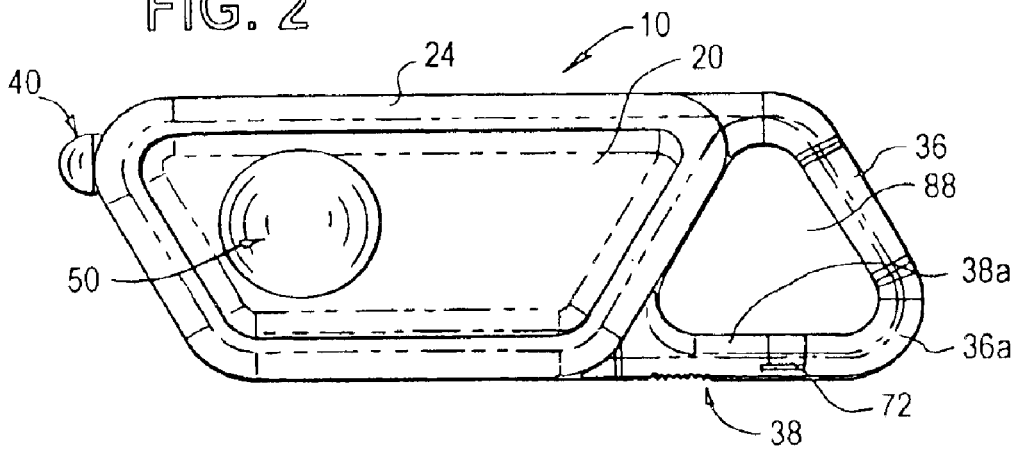
FIG. 2 is a side elevational view of the flashlight depicted in FIG. 1.
Figure 3:
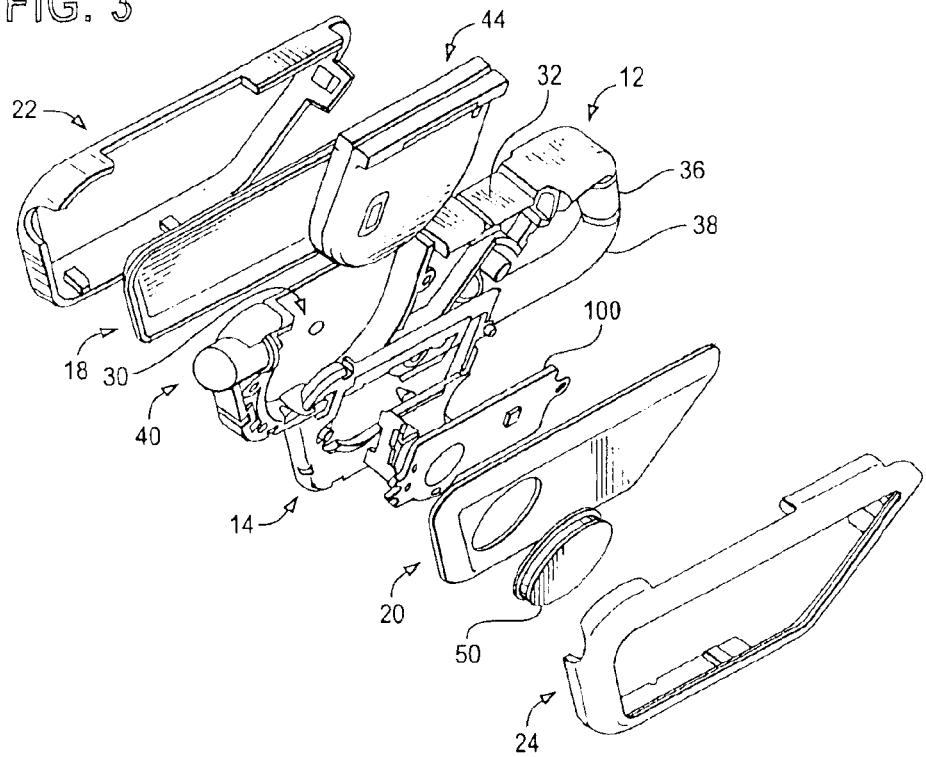
FIG. 3 is an exploded perspective view of the flashlight of FIGS. 1 & 2.

Referring now to the drawings, and in particular to FIGS. 1–3, a miniature handheld flashlight made in accordance with the present invention is indicated generally at 10. Very generally, and as illustrated in the exploded view of FIG. 3, the flashlight 10 has a housing which, in the preferred embodiment, includes a battery frame 12 that supports a high intensity light source 40 at a front end of the battery frame and to which is attached a printed circuit board (PCB) plate 14 and attached PCB 100, side covers 18 and 20, and open centered side shells or frames 22 and 24 that retain the side covers against opposite side of the battery frame. The battery frame 12, PCB plate 14 and PCB 100 cooperate to define a recess or chamber 30 that extends into the battery frame and opens outwardly of an edge surface 32 of the battery frame to facilitate sliding insertion of a replaceable battery pack as indicated at 44.

A keyring extension 36 is formed on an end of the battery frame 12 opposite the light source 40 and includes a keyring lock 38 that enables attachment of keys or a keychain to the keyring extension, or attachment of the flashlight to one's clothing or other item. As shown, the battery frame 12, side covers 18, 20, side shells 22, 24 and keyring extension define a housing that is relatively thin or flat in edge profile and has substantially greater longitudinal length than height, as considered in FIG. 2.

Figure 4:
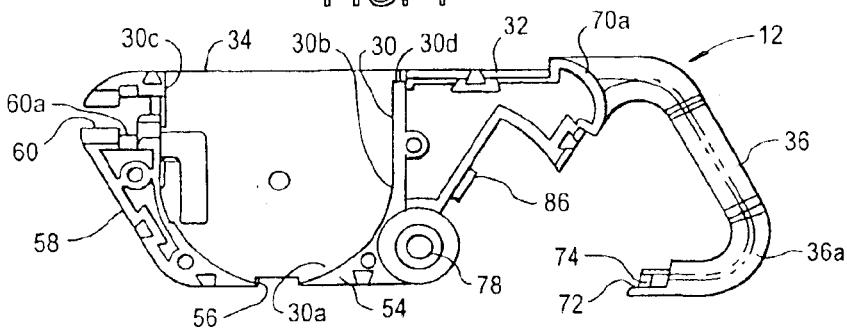
FIG. 4 is a side elevational view of one side of the power source battery frame employed in flashlight of FIG. 1.
Figure 5:
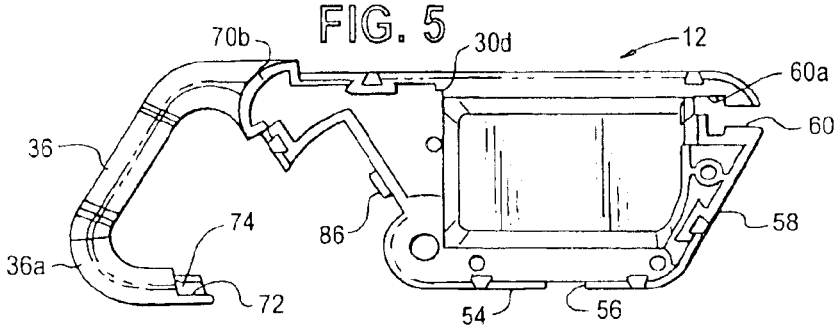
FIG. 5 is an elevational view of the opposite side of the battery frame of FIG. 4.

Turning now to a more detailed description of the various components of the flashlight 10, and referring particularly to FIGS. 4 and 5, the battery frame 12 is preferably made of a non-conductive material, such as polycarbonate, which provides exceptional durability and toughness. The battery frame 12 may also be made of other non-conductive materials having suitable strength and durability characteristics. As illustrated in FIG. 4, the battery frame 12 has a first side defining a portion of the recess 30. In the illustrated embodiment, the recess 30 has a semi-circular bottom surface portion 30*a* which terminates at its upper ends in parallel rectilinear walls surfaces 30*b* and 30*c*. The lower curved wall surface 30*a* intersects a bottom or lower edge surface 54 of the battery frame to form a generally rectangular opening 56 that provides access to the recess 30. The battery frame has a front end wall surface 58 that lies in a plane inclined to the upper end surfaces 32 and 54, respectively, of the battery frame and terminates at its upper end in a recess or chamber 60 configured to receive the light source 40.

Figure 21:
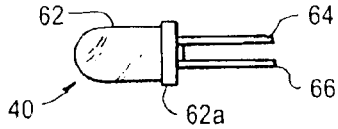
FIG. 21 illustrates an LED light source having leads extending therefrom as employed in the flashlight of FIG. 1.

As illustrated in FIG. 21, the light source 40 preferably comprises a high intensity light emitting diode ("LED") 62 having first and second leads 64 and 66. The LED 62 has an annular ring 62*a* thereon which couples with a semi-annular grove 60*a* formed in the recess 60 so as to maintain the LED in substantially fixed relation to the battery frame 12 when inserted into the recess 60. The LED light source provides significant advantages over conventional neon or incandescent filament light sources since it requires much less energy, is smaller in size, more resistant to shock, and provides a soft general illumination without "white out" or glare as experienced with traditional filament type light sources. The LED also generates significantly less heat and is more durable than a conventional light source. LED's are widely available, inexpensive, and can be readily replaced. In a preferred embodiment, the LED is a high intensity LED having a light luminous intensity emitting blue light, preferably a LED "E" grade or a lensed "D" grade.

Figure 28:
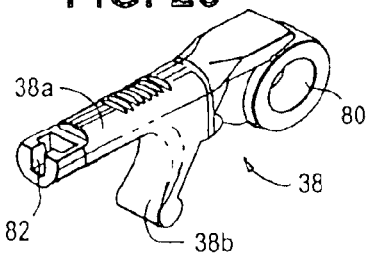
FIG. 28 is a perspective view, on an enlarged scale, of the keylock shown in FIG. 3.

Referring to FIGS. 4 and 5, taken in conjunction with FIGS. 2 and 28, the keyring extension 36 is preferably made of the same polycarbonate material as the remainder of the battery frame 12 and is formed integral with the remainder portion. The keyring extension 36 preferably blends into the upper edge surface 32 of the battery frame and is of greater transverse width at that point so as to define arcuate edge surfaces 70*a* and 70*b* that will eventually mate with correspondingly curved surfaces on the open center side shells or frames 22 and 24 so as to form a smooth and aesthetically pleasing exterior surface of the flashlight 10. The keyring extension 36 extends from its upper end in an inclined direction generally parallel to the front end surface 58 of the battery frame. This portion of the keyring is of generally cylindrical configuration and formed with a rounded lower corner 36*a* so as to terminate in a notched end 72 having an upstanding short wall 74 of less width than the diameter of the end 36*a* of the keyring extension.

The battery frame 12 has a cylindrical boss or hub 78 formed integral thereon so as to extend transversely of the longitudal axis of the battery frame. The boss 78 pivotally supports the keyring lock 38 through a cylindrical bore 80 (FIG. 28) in the keyring lock. As illustrated in FIG. 28, the keyring lock 38 has an arm 38*a* that lies in a plane disposed generally transverse to the axial center of the bore 80 and has a length sufficient to cause a notched end 82 of the arm 38*a* to releasably couple with the upstanding wall 74 on the notched end 72 of the keyring extension 36*a* when the keyring lock is in a closed position as shown in FIG. 2. As shown in FIG. 3, a coil compression spring is interposed between a boss 86 formed on the battery frame 12 and a boss (not shown) on an arm 38*b* of the keyring lock 38 so as to bias the keyring lock into a releasable locking or engaging position with the end 72 of the keyring extension 36*a*. The keyring extension 36 and keyring lock 38 cooperate to define a generally rectangular opening 88 that readily enables keys or a keychain to be inserted into the opening 88 for connection to the keyring extension by depressing the keyring lock against the compression spring. The opening 88 is also sufficiently sized to enable the flashlight to be connected to one's clothing, such as over a pocket edge, through a belt loop, or through a buttonhole.

Figure 12:
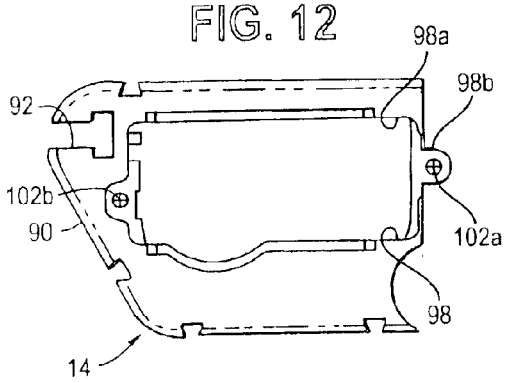
FIG. 12 is a side elevational view of the PCB plate that cooperates with the battery frame to establish the modular battery pack recess, and which also supports the PCB shown in FIG. 14.

As aforedescribed, the recess 30 formed in the battery frame 12 opens outwardly from a side edge 32 of the battery frame, as shown in FIG. 3. The PCB plate 14 is adapted for mounting on the battery frame 12 to become a part of the battery frame. The PCB plate 14 and PCB 100 define a boundary surface of the recess 30 opposite a planar wall surface 30*d* shown in FIG. 4. To this end, and referring to FIGS. 12 and 13 taken in conjunction with FIG. 4, the PCB plate 14 is made of a non-conductive material, such as a moldable polycarbonate, and has a planar surface 14*a* having a peripheral boundary substantially the same as the recess 30 formed in the battery frame 12. The PCB plate 14 has a forward inclined edge surface 90 that terminates at its upper edge in a recess 92 that compliments the recess 60 in the battery frame 12 to complete the LED mounting chamber for the LED 62 when the PCB plate 14 is mounted on the battery frame. To facilitate mounting on the battery frame, the PCB plate 14 preferably has a plurality of generally cylindrical mounting pins or pegs formed thereon, such as indicated at 96*a–d* in FIG. 13, that are inserted into correspondingly located pegholes formed in the battery frame 12. The mounting pegs and associated pegholes may couple in a friction fit or be secured by a suitable adhesive.

Figure 13:
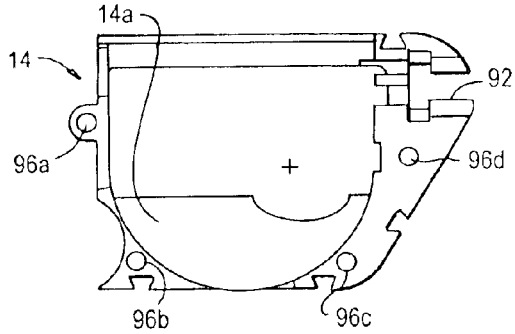
FIG. 13 shows the opposite side of the PCB plate of FIG. 12.

As seen in FIG. 13, the PCB plate 14 has a recess 98 formed therein, a portion 98*a* of which extends fully through the PCB plate. The recess 98 and corresponding through-portion 98*a* are configured to receive the PCB 100 therein and which is adapted to interconnect one of the leads of the LED to a positive terminal of the battery pack without effecting physical contact of the lead with the battery, as will be described.

A portion 98*b* of the recessed area 98 is provided to secure the PCB 100 to the PCB plate 14. A set of pegs 102*a–b* are provided to engage a corresponding set of pegholes 104*a–b* in the PCB 100.

Figure 14A:
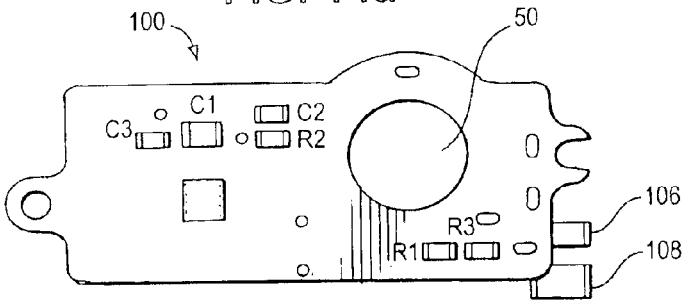
FIGS. 14*a*–*c* is a front, edge and a reverse perspective view of the PCB.
Figure 14B:
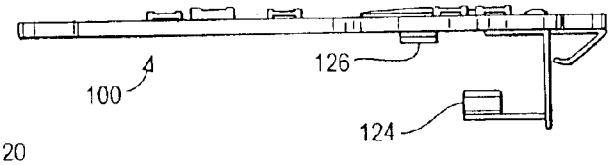
Figure 14C:
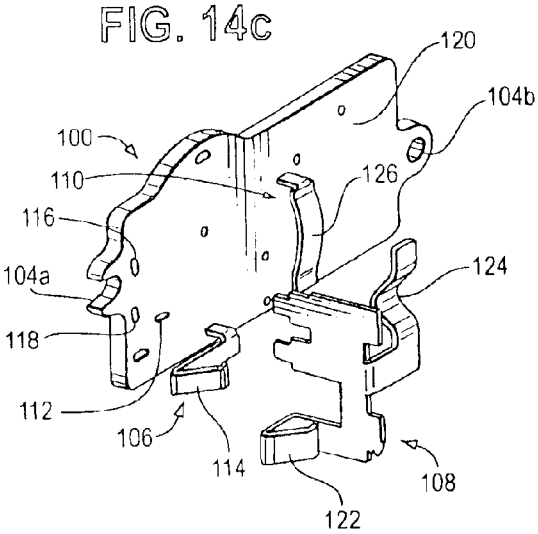

FIGS. 14*a–c* depict details of the PCB 100. FIG. 14*a* shows the circuit side, FIG. 14*b* shows an edge view and FIG. 14*c* shows an exploded, perspective view of the back of the PCB 100. FIG. 14*c* shows the side of the PCB 100 that faces the recess 30.

Figure 15:
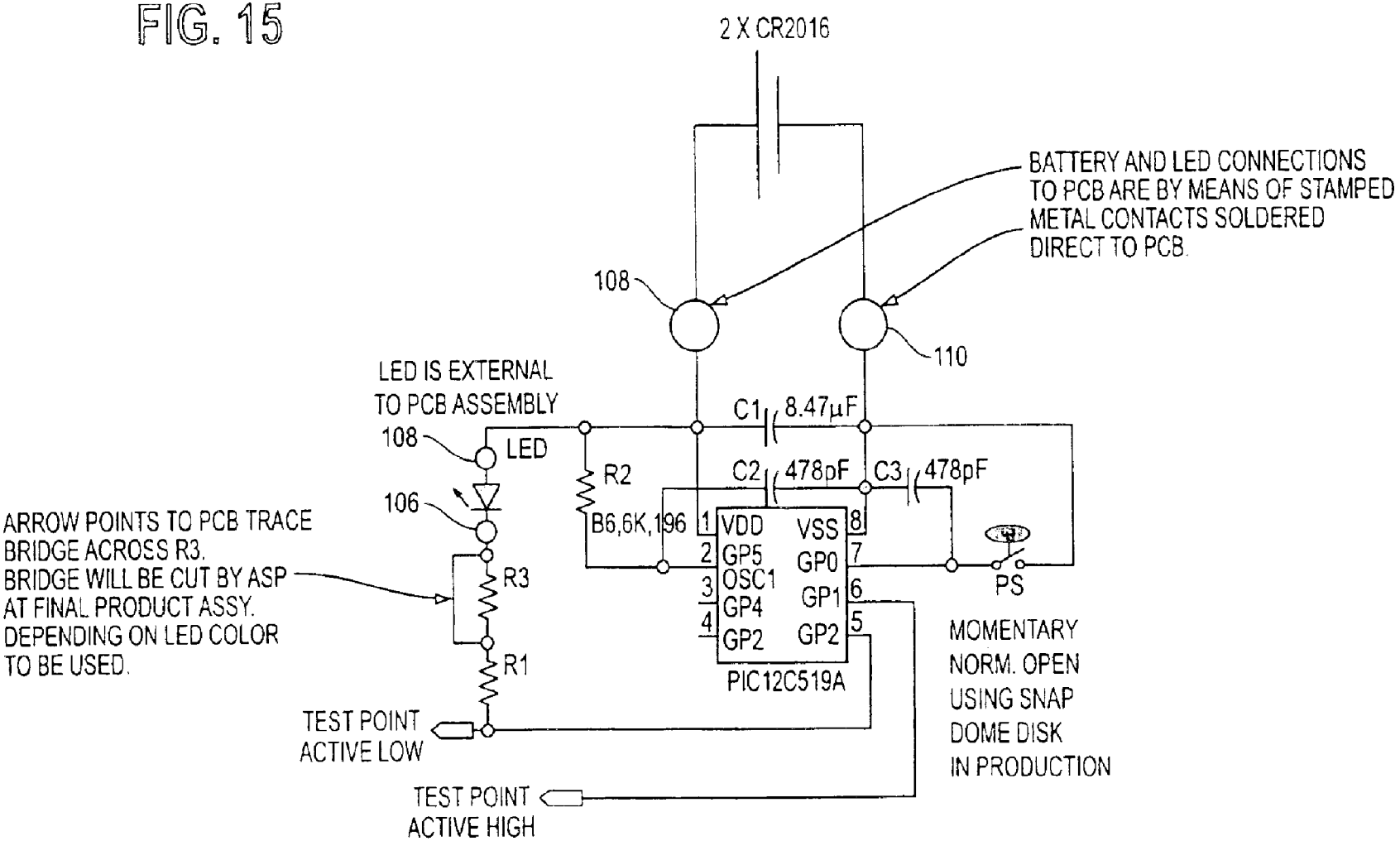
FIG. 15 is a schematic diagram of the PCB and interconnections with the LED and battery of FIG. 3.

FIG. 15 shows a schematic of the circuit located on the circuit side of FIG. 14. Reference to FIGS. 14*a–c* and 15 shall be made as appropriate to an understanding of the invention.

FIG. 14*c* shows first, second and third electrical conductors contacts 106, 108, 110. The first electrical conductor contact 106 is secured to the circuit board 120 within a first soldered through-hole 112 and has a tapered edge 114 for engaging a first lead of the LED 62. The soldered through hole 112 of the first contact 106 is connected to output GP2 of processor U1 shown in FIG. 15 through resistors R1 and R3.

The second electrical conductor contact 108 is connected to the circuit board 112 through a pair of soldered through-holes 116, 118. A first tapered edge 122 of the second contact 108 engages the second lead of the LED 62. A second recurved portion 124 is engages the positive terminal of the battery pack 44. The soldered through-holes 116, 118 are provided to connect with the resistor R2, capacitor C1 and the positive connection Vdd on the processor U1.

The third electrical conductor contact 110 is adapted to contact a negative terminal of the battery pack 44. A soldered through-hole (not shown) may be provided to couple the contact 110 to capacitors C1, C2, the negative connection Vss of the processor U1 and to the momentary contact pushbutton (PB) 50.

The PCB 100 may be assembled to the PCB plate 14 by inserting the pegs 102*a–b* into the pegholes 104*a–b*. The assembled PCB plate 14 may then be assembled to the side of the chamber 30. Within the chamber 30, the contact 124 extends across the width of the recess 30 and engages the battery pack 44 from the far side. The contact 126 engages the battery pack 44 from a near side. Assembly causes the first and second conductors 106, 108 are brought into contact with the leads of the LED 62.

The pushbutton 50 may be a snap dome switch plate with external cover. The pushbutton 50 may be constructed substantially as described in U.S. Pat. No. 6,190,018.

Figure 16:
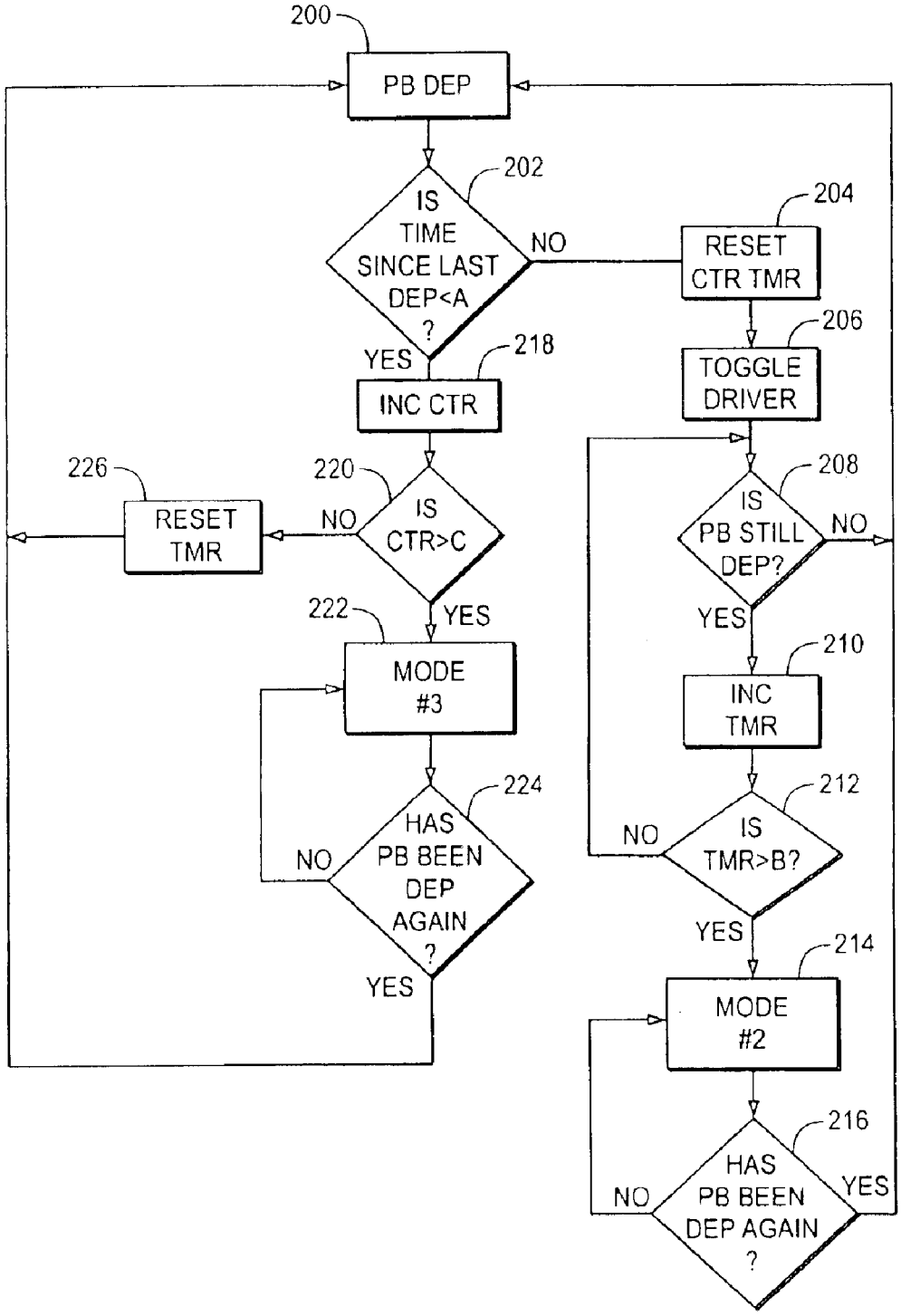
FIG. 16 is a flow chart that illustrates the mode selection of the flashlight 10 of FIG. 1.
Figure 17:
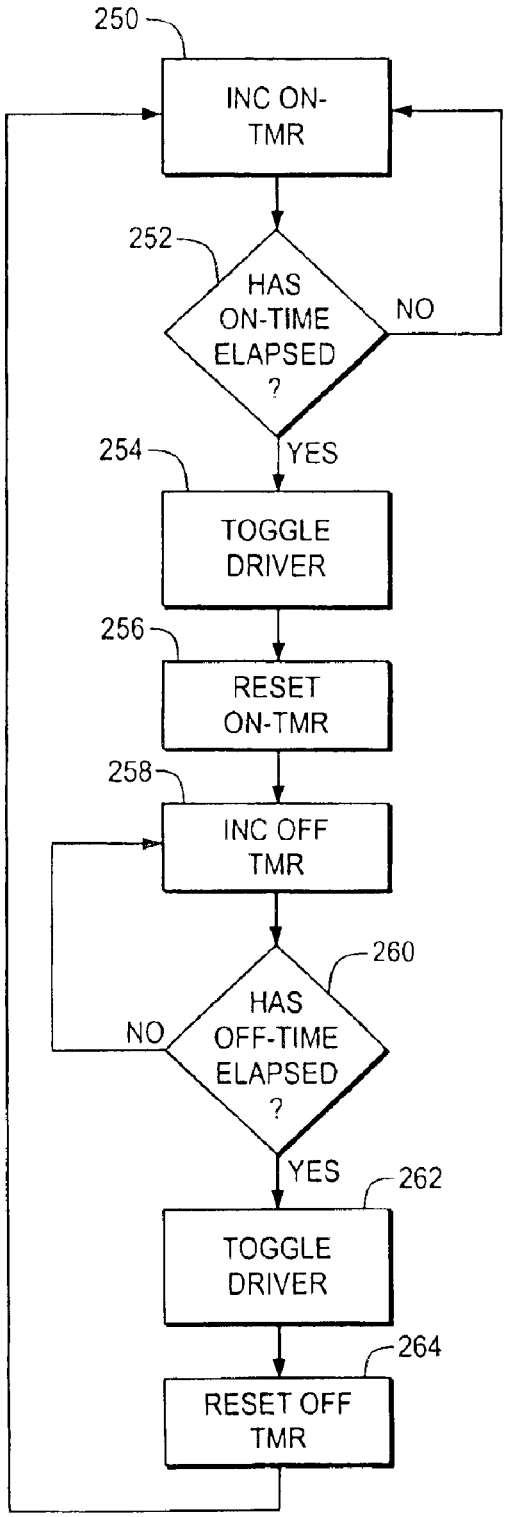
FIG. 17 is a flow chart that illustrates the flashing mode of FIG. 16.

FIGS. 15–17 are flow charts of a number of operating modes that may be assumed by the flashlight 10. FIG. 16 shows process steps by which the processor U1 may assume any of a number of different operating modes. While any number of different modes may be contemplated, three different modes will be described under illustrated embodiments of the invention.

The first mode may be a simple on-off mode. The second mode may be a flashing mode that may be accomplished using the steps depicted in the flow chart of FIG. 16. The third mode may be an SOS mode whereby the LED 40 flashes out the letters SOS in morse code. Operation under the third mode may be accomplished following the steps of the flow chart of FIG. 17.

The first mode may be a default mode assumed by the processor U1 upon startup. The second, flashing mode may be assumed by entry of some predetermined input code into a mode selector 358 (FIG. 19) through the pushbutton 50 (e.g., depressing the button 50 continuously for 5 seconds). The third, SOS mode may be assumed by entering some other code through the pushbutton 50 (e.g., activating the pushbutton 50 in rapid succession three times with no more than 0.5 seconds between activations).

As used herein, entry of an input code means the activation of the pushbutton 50 in such a manner as to match one or more predetermined timing (i.e., access) codes stored within the processor. It does not mean the simple activation of a pushbutton to turn a flashlight on or off or holding the pushbutton in a depressed state while the flashlight precesses through a number of operational states.

In order to conserve power, the processor U1 is programmed to assume a sleep mode between processing events. Insertion of a battery or a change in the state of port 0 (GP0) causes the processor to awaken, restore its registers and accept any new commands.

Turning now to FIG. 16 an explanation will be offered of a process through which the flashlight 10 may assume any one of three different modes. In each case, the processor U1 compares a temporal activation sequence of the pushbutton 50 with a predetermined access (e.g., timing) code associated with each mode. Where a match is found, the processor U1 enters the mode corresponding to the match.

As mentioned above, the processor U1 may wake-up upon detection of battery insertion or activation 200 of the pushbutton 50. Since the processor has just awakened, the time since the last depression of the pushbutton 50 will be some maximum value. Consequently, the first test 202 will be negative. Following the first test, a mode counter 318 (FIG. 19) and a repetition timer 310 that measures the time since the pushbutton was last activated may be reset 204 to zero. Following the reset, a driver 320 of the LED 40 will be toggled. IF the LED 40 were on, then the LED 40 would be toggled off. Alternatively, if the LED 40 where off, then the LED 40 would be toggled on.

As a next step, the processor U1 may test 208 whether the pushbutton 50 is still activated (i.e., depressed). If the pushbutton 50 is still being depressed, then a pushbutton timer 322 is incremented 210. The value within the pushbutton timer 322 is then compared within a pushbutton time comparator 324 to determine whether the time value has exceeded a pushbutton threshold value "B" (e.g., 5 seconds). If the value exceeds the threshold value "B", then the processor U1 enters 214 a second mode (i.e., mode #2).

Figure 19:
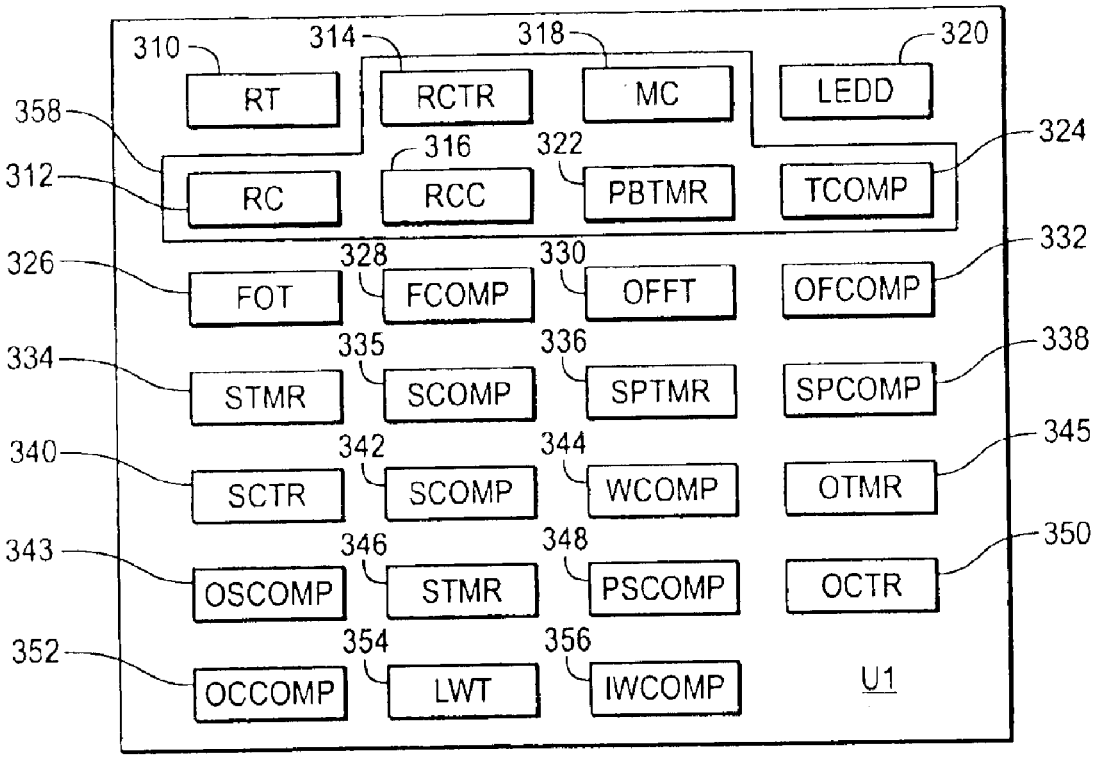
FIG. 19 is block diagram that illustrates the function blocks of the processor of FIG. 16.

Alternatively, if the pushbutton 50 where released and pressed again, then the processor U1 may proceed along another path. After the first activation of the pushbutton 50, the processor U1 has reset the repetition timer 310 (FIG. 19). The value of the repetition timer 310 may now be compared 202 within a repetition comparator 312 with a repetition threshold value "A" (e.g., 0.5 seconds) to detect a request for the third mode. In the case where the code for entry into the third mode is three rapid activations of the pushbutton 50, each time the comparator detects activation of the pushbutton within the time period "A", a repetition counter 314 may be incremented 218. The value within the repetition counter 314 may be compared with a threshold value "C" (e.g., 3) within a repetition counter comparator 316. If the value in the repetition counter 316 exceeds the threshold value, then the processor U1 will enter mode #3.

If the processor U1 is in the mode #2 state, then the process of FIG. 17 may be followed to cause the LED 40 to flash (i.e., flicker) in some predictable manner. For example, the processor U1 may periodically increment 250 a flasher on-timer 326. After each increment, the processor U1 may compare a value within the on-timer 326 with a on-time threshold value in a flasher comparator 328. If the value within the on-timer 326 exceeds the threshold value, then the processor U1 may toggle 254 the driver 320 and begin incrementing 258 an off-timer 330. The value within the off-timer 330 may be compared in a comparator 332 with an off-time threshold value. When the off-timer 330 exceeds the off-threshold, the driver 320 is again incremented and the process repeats.

The on-timer 326 and off-timer 330 together define a flash rate of the flashlight 10 in cycles per minute. The flash rate may be selected to be commensurate with a person walking or jogging so that the light 10 assumes an on-state (i.e., flashes) each time the user's foot contacts the ground.

Further, the duty cycle may be adjusted to conserve battery energy during the flash mode (i.e., mode #2). For example, the on-time may be adjusted to be only a small percentage (e.g., 5% or less) of the total time of each flash cycle. The net result is a strobing effect that allows a user to clearly see his surroundings while at the same time maximizing battery life.

The process in mode #3 may be somewhat similar. However, since mode #3 involves morse code, the timing of the on and off cycles may be controlled based upon whether the code element is a dot or a dash. In general, the on-time of a dot may be controlled by a time value "A". The off-time between dots may be controlled by a time value "B". Similarly, the on-time of a dash may be controlled by time value "C" and the off-time by time value "D". A time period between transmission of code sequences may be controlled by a time value "E".

Figure 18:
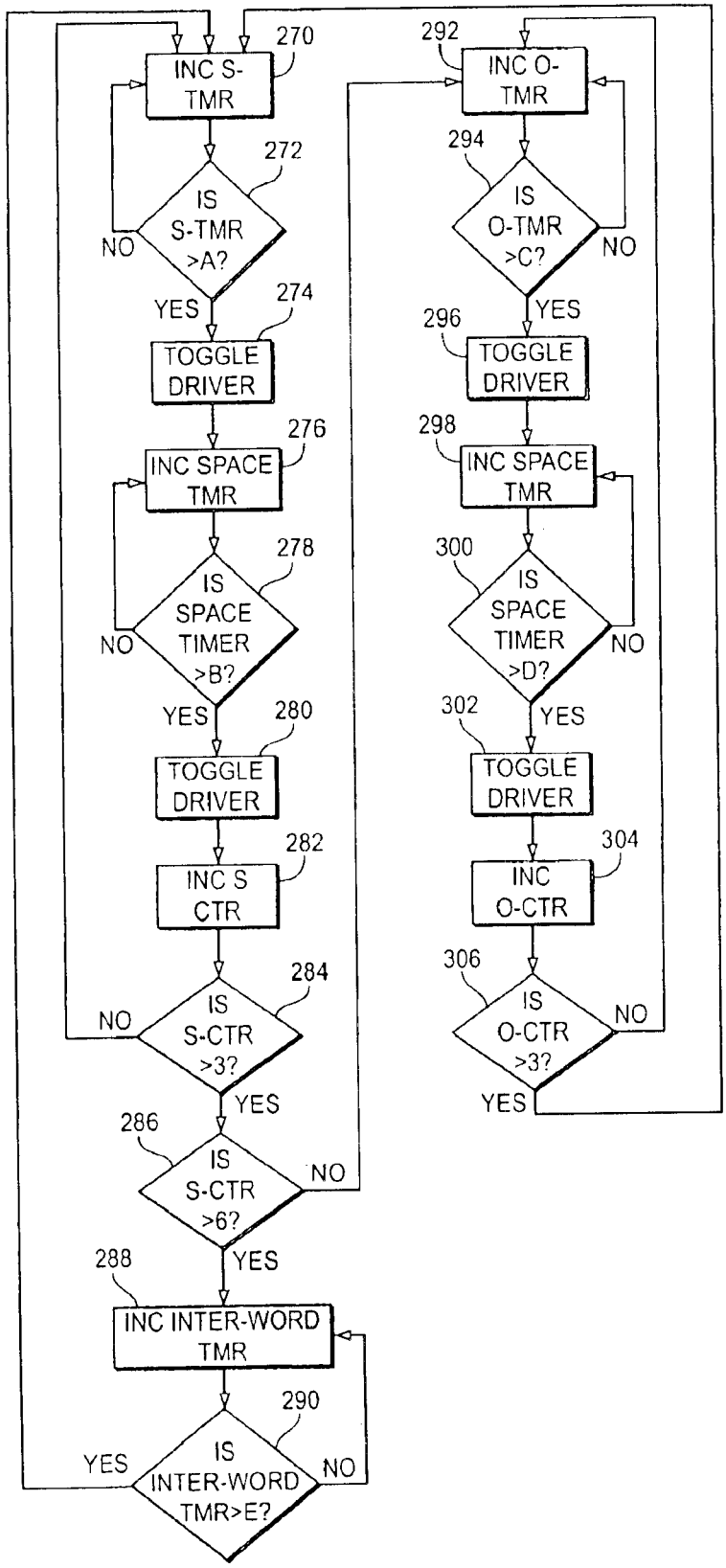
FIG. 18 is a flow chart that illustrates the SOS mode of FIG. 16.

In general, the processor U1 operating in mode #3 may enter an S-generator (left column of FIG. 18) at step 270 where an S-timer 334 is incremented. After the S-timer is incremented, an S-comparator 334 compares 272 the value within the S-timer with the threshold time value "A". If the value within the S-timer 334 does not exceed the threshold value, then the value within the S-timer 334 is incremented and the process is repeated. If the S-timer exceeds the threshold value, then the LED driver 320 is toggled 274 and the processor U1 proceeds to begin measuring a time space between dots.

To measure a space, a space timer 336 is incremented 276. After incrementing the space timer 336, a comparator 338 compares the time within the space timer 336 with the threshold value "B". If the time does no exceed the threshold then the steps 276, 278 repeat. If the time exceeds the threshold, then the driver 320 is toggled 280 and the process to count the number of dots generated so far.

To count the number of dots, an S-counter 340 is incremented 282. After the S-counter 340 is incremented, an S-comparator 342 compares 284 the count within the S-counter 340 with a first threshold value (e.g., 3). If the S-counter 340 does not exceed the first threshold, the process 270, 272, 274, 276, 278, 280, 282, 284 repeats.

If the value within the S-counter 342 exceeds the first dot threshold value, then a word comparator 344 compares 286 the value within the S-counter 340 with a word threshold value (e.g., 6). When the value within the S-counter 340 exceeds the word threshold, then the process proceeds to an "O" generator (right column in FIG. 18).

As a first step, an O-timer 342 is incremented 292. After the O-timer 342 is incremented, a O-comparator 344 compares 294 the value within the O-timer 342 with a dash time threshold "C". If the threshold has not been exceeded, the timer 342 is incremented and the steps 292, 294 repeat. If the threshold "C" is exceeded, then the processor U1 toggles 296 the driver 320 and a dash space timer 346 is incremented 298.

A dash-space comparator 348 then compares 300 the value within the dash space timer 346 with a threshold value "D". If the time does not exceed the value, then the timer is incremented and the steps 298, 300 repeat. If the timer does exceed the threshold, then the driver 320 is toggled 302 and an O-counter 350 is incremented 304.

The O-counter 350 counts the number of dashes generated. An O-count comparator 352 then compares 306 the O-count with a threshold value (e.g., 3). If the O-count does not exceed the threshold, then the process steps 292, 294, 296, 298, 300, 302, 304, 306 repeat. If the O-count does exceed the threshold, then the process loops back to the dot generator and the sequence of dots repeats until the second set of dots has been generated.

Once the second set of dots has been generated, the word comparator 344 detects completion of the SOS sequence by comparison 286 of the value of the S-counter 340 with the threshold value (e.g., 6) and the process proceeds to an interword timer 356 that provided introduces a timer interval between SOS code sequences. The interword timer 356 is incremented 288. An interword comparator 356 compares 290 the value within the timer 354 with a threshold value (e.g., 2 seconds). If the value does not exceed the threshold, the timer 354 is incremented and the steps 288, 290 repeat. If the value does exceed the threshold, then the processor U1 proceeds to the first step 270 and the whole sequence repeats.

Figure 22:
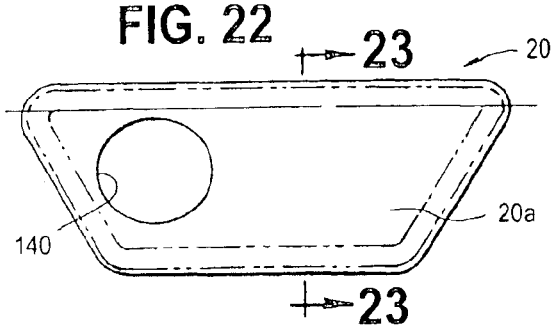
FIG. 22 is a side view of a side cover having an opening to receive the switch push button shown in FIGS. 29–30.
Figure 23:
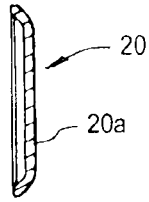
FIG. 23 is a transverse cross sectional view taken along line 23—23 of FIG. 22.
Figure 24:
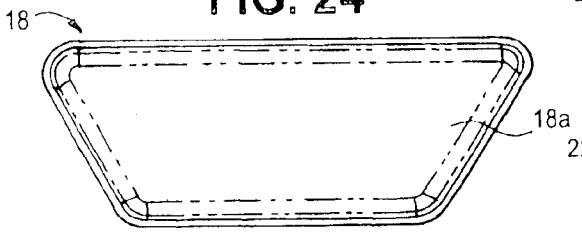
FIG. 24 is a side view of a second side cover.
Figure 25:
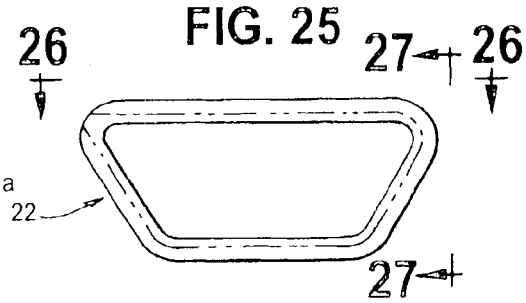
FIG. 25 is an elevational view of a side shell open frame used to retain a side cover against the battery frame.
Figure 26:
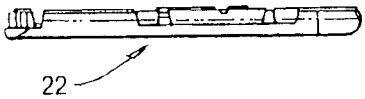
FIG. 26 is a top edge view taken along line 26—26 of FIG. 25.
Figure 27:
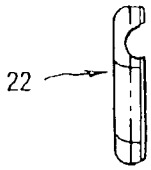
FIG. 27 is a side edge view taken along line 27—27 of FIG. 25.

Returning now to the physical structure of the flashlight 10, FIGS. 22 and 24 are side views of the side covers 20 and 18, respectively, which are substantially mirror images of each other and are adapted to be placed against opposite sides of the battery frame 12 when having the battery frame 14 mounted thereon as aforedescribed. To this end, the outer peripheries of the side covers 18 and 20 are sufficient to overlie the opposite sides of the battery frame and be secured thereagainst by the open-centered side shells or frames 22 and 24 which are substantially mirror images of each other and are adapted to be secured to the battery frame in a manner similar to the technique for attaching the housing sides 140 and 150 disclosed in U.S. Pat. No. 6,190,018 to the corresponding power source frame 22; namely, by forming pegs on the inner surfaces if the of the side shells 22 and 24 which are inserted into and retained within suitably positioned peg holes in the battery frame 12.

The side covers 18 and 20 are generally flat so as to form generally planar surface areas 18*a* and 20*a*, respectively, that preferably lie in parallel planes when assembled onto the battery frame 12 and retained thereagainst by the side shells 22 and 24. The side shells 22 and 24 substantially seal the peripheral edges of the side covers 18 and 20. The side covers 18 and 20 are made of a suitable strength material including metal, rubber, and plastic. The side covers are preferably made of aluminum, such as anodized 6061 aluminum, and their generally planar surfaces are suitable for putting indicia thereon by engraving or printing as aforedescribed.

The side cover 20 has a circular opening 140 formed therethrough and sized to receive the push button 50. The opening 140 is positioned so that when the side cover 20 is mounted on the side of the battery frame 12 on which the PCB plate 14 is mounted. The push button 50 may be made of a relatively soft plastic material (e.g., Kraton) and has an outer dome shaped surface having a diameter equal to the opening 140.

Figure 6:
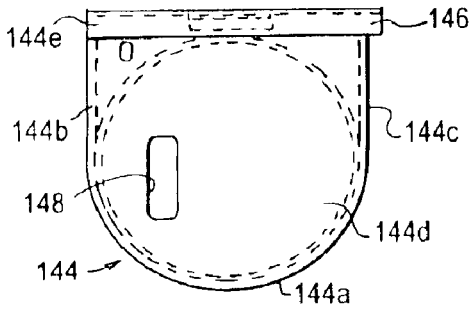
FIG. 6 is a front view of one-half of the battery holder that receives the battery of FIG. 20 to form the modular battery pack shown in FIG. 3.
Figure 7:
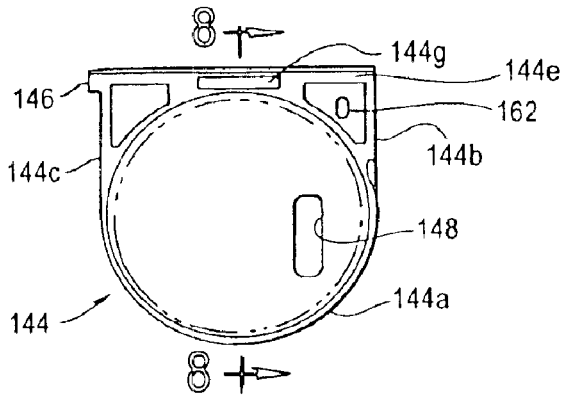
FIG. 7 shows the opposite side of the battery holder of FIG. 6.
Figure 8:
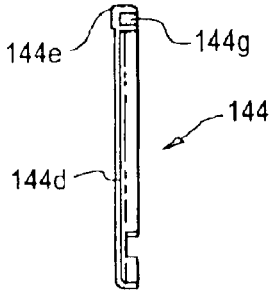
FIG. 8 is a sectional view taken along line 8—8 of FIG. 7.

FIGS. 6–8 illustrate one-half of a battery holder, indicated at 144, that is preferably made of polycarbonate and has a circular bottom end wall 144*a* that blends into parallel side walls 144*b* and 144*c* all of which are integral with a planar outer wall 144*d* of the battery holder. The sidewalls 144*b,c* and outer wall 144*d* are connected to an upper transverse rim 144*e* having an upper surface that forms one-half of the battery pack upper surface 46. The upper transverse rim 144*e* extends slightly beyond the adjacent sidewall 144*c* to define a portion of a projection 146 on the battery holder that is adapted to be received in a recess or notch 30*d* formed in the upper surface 46 of the battery frame 12, as considered in FIG. 4, thereby requiring a predetermined orientation of the batter pack in order to insert it fully into the recess 30 in the battery frame.

Figure 9:
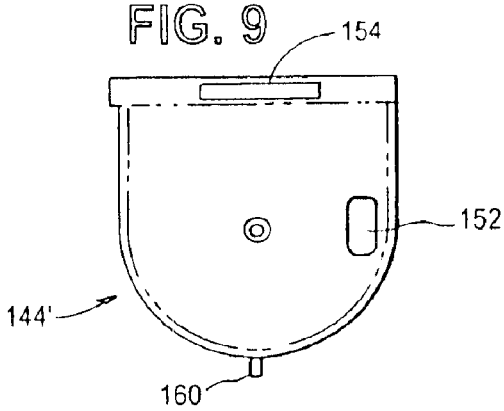
FIG. 9 is a front view of the other half of the battery holder that forms the modular battery pack.
Figure 10:
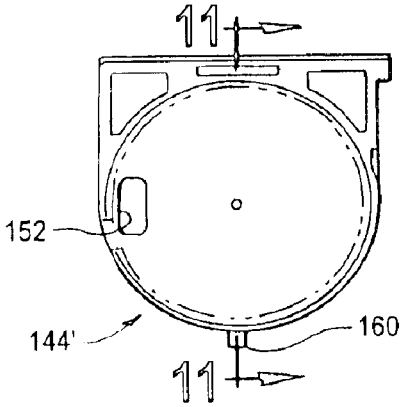
FIG. 10 shows the opposite side of the battery holder half of FIG. 9.
Figure 11:
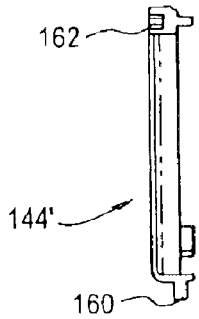
FIG. 11 is a sectional view taken along line 11—11 of FIG. 10.
Figure 20:
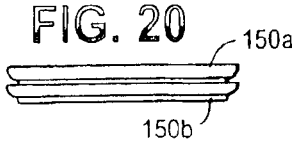
FIG. 20 is an edge view of a two-battery power source of the coin type that is enclosed within the battery holder to create the battery pack shown in FIG. 3.

FIGS. 9–11 illustrate the other half of the battery holder 44, indicated at 114'. FIG. 9 shows the outer surface of the battery holder half 144', and FIG. 10 shows the opposite inner surface. The battery holder half 144' is a substantial mirror image of the holder half 144 so that the battery holder halves can be secured together to form a holder having a circular interior chamber to receive a pair of stacked coin type batteries 150*a* and 150*b* as shown in FIG. 20. The planar wall 144*d* of the battery holder half 144 has a rectangular opening 148 formed therethrough which is preferably chamfered at its outer periphery in the outer exposed wall 144*d*. The rectangular opening 148 is adapted to expose the positive terminal of a pair of stacked batteries disposed within the battery holder and is positioned to receive the V-shaped portion 124 of the conductor contact 108 in continual contact with the battery terminal when the battery pack is disposed within the battery frame recess 30.

The battery holder half 144' has a rectangular opening 152 that is adapted to expose the negative terminal of the battery pack and is positioned to receive a negative conductor contact as indicated at 110 in FIG. 14*c*. The contact 110 is also preferably made of 301–302 stainless steel and has a generally curved portion 126 that projects into the opening 152 in the battery pack to constantly contact the negative battery terminal when the battery pack is inserted in the recess 30.

A cylindrical post 160 is formed on the battery pack, such as on the bottom of battery holder half 144', that can be inserted into the battery pack recess opening 56 in the battery frame 12 and used to partially eject a battery pack when the post 160 has been fully inserted into the recess. In this manner, a replacement battery pack can be used to assist in ejecting a battery pack from the battery frame to facilitate replacement.

A nail nick 154 is provided on a side of the battery pack near the top edge. Once the battery pack is partially ejected by the replacement battery pack, the user may insert his fingernail into the nail nick 154 and easily pull the old battery pack out of the flashlight 10.

A paper clip recess 162 may also be provided on a side of the battery pack near the top edge. The paper clip recess 162 allows the use of a paper clip for removal of the partially ejected battery pack.

It can thus be seen that the flashlight in accordance with the present invention can be readily operated by selection of any of a number of different operating modes via operation of the pushbutton 50. Selection of operating modes may be accomplished by entry of any of a number of different codes through the pushbutton 50. Once a mode is selected, an internal processor automatically activates the LED 62 in accordance with the selected operating mode. These features, coupled to the replaceable battery pack feature, presents a small flat flashlight that is a marked improvement over known flashlights.

While a preferred embodiment of the present invention has been illustrated and described, it will be understood that changes and modifications may be made therein without departing from the invention in its broader aspects.

What is claimed is:

1. A method of operating a flashlight using a light emitting diode as a primary light source, the method comprising the steps of:

providing the flashlight with a plurality of different operating modes;

activating the light emitting diode as the primary light source of the flashlight under one of the plurality of different operating modes; and selecting one of the plurality of operating modes by entering a code corresponding to the selected one of the plurality of operating modes through a momentary contact switch disposed on an outer surface of the flashlight where said selection of the operating mode further comprises matching a set of time intervals between successive activations of the momentary contact switch with one or more predetermined timing codes stored within the flashlight and where selection of operating mode is accomplished via direct access without passing through other operating modes of the plurality of operating modes.

2. The method of operating the flashlight as in claim 1 wherein one of the plurality of operating modes further comprises an on/off mode.

3. The method of operating the flashlight as in claim 2 further comprising activating the momentary contact once to select the on/off mode.

4. The method of operating the flashlight as in claim 1 wherein one of the plurality of operating modes further comprises a flashing mode.

5. The method of operating the flashlight as in claim 4 further comprising activating the momentary contact continuously for a predetermined time period to select the flashing mode.

6. The method of operating the flashlight as in claim 1 wherein one of the plurality of operating modes further comprises an SOS mode.

7. The method of operating the flashlight as in claim 6 further comprising activating the momentary contact a plurality of times in rapid succession to select the SOS mode.

8. The method of operating the flashlight as in claim 7 wherein the step of activating the momentary contact a plurality of times in rapid succession to select the SOS mode further comprises activating the momentary contact three times no more than one-half second apart.

9. The method of operating the flashlight as in claim 6 where in the SOS mode further comprises generating a morse code light signal for the letters SOS.

10. Apparatus for operating a flashlight using a light emitting diode as a primary light source, the apparatus comprising:

means for activating the light emitting diode as the primary light source of the flashlight under one of a plurality of different operating modes; and means for selecting one of the plurality of operating modes by entry of a code that corresponds to the selected operating mode where said means for selecting further comprises means for matching a set of time intervals between successive activations of the momentary contact switch with one or more predetermined timing codes stored within the flashlight and where selection of the operating mode is accomplished via direct access without passing through other operating modes of the plurality of operating modes.

11. The apparatus for operating the flashlight as in claim 10 wherein one of the plurality of operating modes further comprises an on/off mode.

12. The apparatus for operating the flashlight as in claim 11 further comprising means for activating the means for selecting once to select the on/off mode.

13. The apparatus for operating the flashlight as in claim 10 wherein one of the plurality of operating modes further comprises a flashing mode.

14. The apparatus for operating the flashlight as in claim 13 further comprising means for activating the means for selecting continuously for a predetermined time period to select the flashing mode.

15. The apparatus for operating the flashlight as in claim 10 wherein one of the plurality of operating modes further comprises an SOS mode.

16. The apparatus for operating the flashlight as in claim 15 further comprising means for activating the means for selecting a plurality of times in rapid succession to select the SOS mode.

17. The apparatus for operating the flashlight as in claim 16 wherein the means for activating the means for selecting a plurality of times in rapid succession to select the SOS mode further comprises means for activating the means for selecting three times no more than one-half second apart.

18. The apparatus for operating the flashlight as in claim 10 wherein the SOS mode further comprises means for generating a morse code light signal for the letters SOS.

19. Apparatus for operating a flashlight using a light emitting diode as a primary light source, the apparatus comprising:

a processor adapted to activate the light emitting diode as the primary light source of the flashlight under one of a plurality of different operating modes;

a plurality of predetermined timing sequences stored within a memory where each predetermined timing sequence of the plurality of timing sequences corresponds to a respective operating mode of the plurality of operating modes; and a mode selector adapted to select one of the plurality of operating mode by matching a temporal activation sequence of a momentary contact switch with the predetermined timing sequence that correspondes to the selected operating mode and where selection of the operating mode is accomplished via direct access without passing through other operating modes of the plurality of operating modes.

20. The apparatus for operating the flashlight as in claim 19 wherein one of the plurality of operating modes further comprises an on/off mode.

21. The apparatus for operating the flashlight as in claim 20 further comprising a first timer adapted to detect activation of the momentary contact once to select the on/off mode.

22. The apparatus for operating the flashlight as in claim 19 wherein one of the plurality of operating modes further comprises a flashing mode.

23. The apparatus for operating the flashlight as in claim 22 further comprising a second timer adapted to detect activation of the momentary contact continuously for a predetermined time period to select the flashing mode.

24. The apparatus for operating the flashlight as in claim 19 wherein one of the plurality of operating modes further comprises an SOS mode.

25. The apparatus for operating the flashlight as in claim 24 further comprising a counter adapted to detect activation of the momentary contact a plurality of times in rapid succession to select the SOS mode.

26. The apparatus for operating the flashlight as in claim 25 wherein the counter further comprises a third timer adapted to detect activation of the momentary contact three times no more than one-half second apart.

27. The apparatus for operating the flashlight as in claim 19 wherein the SOS mode further comprises an SOS subroutine adapted to generate a morse code light signal for the letters SOS.

28. A flashlight comprising:

a light emitting diode adapted to function as a primary light source of the flashlight;

a processor adapted to activate the light emitting diode under a plurality of different operating modes;

a plurality of predetermined timing codes within a memory where a predetermined timing code of the plurality of timing codes corresponds to a respective operating mode of each the plurality of operating modes;

a momentary contact adapted to select one of the plurality of operating modes; and a mode selector adapted to match a temporal activation sequence of the momentary contact with a predetermined timing code that corresponds to the selected operating mode and where selection of the operating mode is accomplished via direct access without passing through other operating modes of the plurality of operating modes.

29. The flashlight as in claim 28 wherein the plurality of operating modes further comprises an off/on mode.

30. The flashlight as in claim 29 wherein the off/on mode further comprises a default mode selected by momentarily activating the momentary contact.

31. The flashlight as in claim 29 wherein the plurality of operating modes further comprises a flasher mode.

32. The flashlight as in claim 31 wherein the flasher mode further comprises a mode selected by continuously activating the momentary contact for a predetermined time period.

33. The flashlight as in claim 32 wherein the predetermined time period further comprises about 5 seconds.

34. The flashlight as in claim 32 further comprising a software timer adapted to provide a predetermined on and off time period of the flasher mode.

35. The flashlight as in claim 28 wherein the plurality of operating modes further comprises an SOS mode.

36. The flashlight as in claim 35 wherein the SOS mode further comprises a mode selected by repetitively activating the momentary contact.

37. A flashlight comprising:

a hand holdable housing;

a power source supported internally of said housing;

a light emitting diode supported by said housing and adapted to function as a primary light source of the flashlight;

a processor supported internally of said housing and cooperable with said power source to activate the light emitting diode under a plurality of different operating modes;

a plurality of predetermined timing codes within a memory of the processor where each predetermined timing code of the plurality of timing codes corresponds to a respective operating mode of the plurality of operating modes;

a momentary contact operably associated with said processor and adapted to select one of the plurality of operating modes; and said processor including a mode selector adapted to match a temporal activation sequence of the momentary contact with a predetermined timing code that corresponds to the selected operating mode and where selection of the operating mode is accomplished via direct access without passing through other operating modes of the plurality of operating modes.

38. The flashlight as defined in claim 37, wherein the light emitting diode extends from one end of said housing, said housing further comprising a keyring extension extending from an end opposite said light emitting diode.

39. The flashlight as defined in claim 37, wherein said housing further comprises at least one side panel.

40. The flashlight as defined in claim 39, wherein said housing further comprises a frame configured to support said at least one side panel, said panel being made of a material dissimilar to the material of the housing.

41. The flashlight as defined in claim 40, wherein said at least one side panel further comprises a metal side panel.

42. The flashlight as defined in claim 39, wherein said at least one side panel further comprises an anodized metal having indicia thereon.

43. The flashlight as defined in claim 37, wherein said housing is translucent.

44. The flashlight as defined in claim 39, wherein said housing further comprises a pair of laterally opposite side panels.

45. The flashlight as defined in claim 44, wherein said side panels further comprises a different color than said housing.

46. The flashlight as defined in claim 37 wherein said power source further comprises a battery pack removably disposed within a recess in said housing.

47. The flashlight as defined in claim 46 wherein the battery pack further comprises a cylindrical post adapted to extend through a battery pack recess opening at a bottom of said recess in said housing to allow partial ejection of the battery pack by inserting a corresponding cylindrical post of another battery pack through an opposite end of the battery pack recess opening.

48. The flashlight as defined in claim 46 wherein said battery pack further comprises a nail nick disposed along an upper edge of said battery pack to allow a user to grasp and remove a partially ejected battery pack with the user's fingernail.

49. The flashlight as defined in claim 46 wherein said battery pack further comprises a paper clip recess disposed along an upper edge of said battery pack to allow a user to engage and remove a partially ejected battery pack with a paper clip.

* * * * *